US005622673A

United States Patent [19]

Reiterer et al.

[11] Patent Number: 5,622,673

[45] Date of Patent: Apr. 22, 1997

[54] GAS PURGING MEANS FOR WALL-SIDE INSTALLATION IN METALLURGICAL MELTING VESSELS

[75] Inventors: Alfred Reiterer, Lorenzen; Günther Nemecz, Leoben, both of Austria

[73] Assignee: Veitsch-Radex Aktiengesellschaft fur Feuerfeste Erzeugnisse, Wien, Germany

[21] Appl. No.: 405,341

[22] Filed: Mar. 16, 1995

[30] Foreign Application Priority Data

Mar. 25, 1994 [DE] Germany ..... 44 10 289.5

[51] Int. Cl.[6] ..... C21C 5/48

[52] U.S. Cl. ..... 266/220; 266/265

[58] Field of Search ..... 266/217, 220, 266/265

[56] References Cited

U.S. PATENT DOCUMENTS

| | | | |
|---|---|---|---|
| 4,815,715 | 3/1989 | Ganson et al. | 266/220 |
| 4,858,894 | 8/1989 | LaBate | 266/265 |
| 5,160,478 | 11/1992 | Rothfuss et al. | 266/265 |

*Primary Examiner*—Scott Kastler

*Attorney, Agent, or Firm*—John F. A. Earley; John F. A. Earley, III

[57] ABSTRACT

The present invention pertains to a gas purging means for wall-side installation in a metallurgical melting vessel.

12 Claims, 2 Drawing Sheets

GAS PURGING MEANS FOR WALL-SIDE INSTALLATION IN METALLURGICAL MELTING VESSELS

SPECIFICATION

The present invention pertains to a gas purging means for wall-side installation in a metallurgical melting vessel. Metallurgical melting vessels in which metal is melted or liquid metal is treated are subsumed under the term metallurgical melting vessel.

A great variety of designs of gas purging means of this class, via which the treating gases are admitted into the metal melt through nozzles, have been known for many years. They are reviewed in *Radex-Rundschau,* 1987, 288.

Such individual gas purging plugs may be installed in both the bottom and the wall area of a metallurgical melting vessel. This is usually done via a so-called well block; however, the direct installation of a gas purging plug in a monolithic lining belongs to the state of the art as well.

The major types of purging plugs are the so-called joint purging plug, purging plugs with "nondirected porosity" and purging plugs with "directed porosity." In the case of the joint purging plug, the gas is fed in via an annular gap between a dense ceramic body and the enveloping sheet-metal jacket. Purging plugs with so-called "nondirected porosity" are characterized by a refractory material with open porosity, through which the purging gas is guided. Gas purging plugs with "directed porosity" are characterized by a plurality of channels of small diameter in a dense refractory matrix, in which the gas is transported along the channels.

DE 39 11 881 C1 discloses a variant of a gas purging plug with directed porosity, in which the channels (directed pores) are formed by small pipes, which are bonded or mortared in as independent parts into correspondingly prepared passage channels after the gas purging plug has been fired.

This prior-art gas purging plug known from DE 39 11 881 C1 is said to be used especially in a vacuum vessel to carry out an RH, DH or RH-OB degassing process. It is installed on the wall side above the so-called snorkle of the vacuum vessel.

The same patent specification also proposes the installation of a plurality of such fired gas purging plugs with small pipes bonded in the side wall.

Gas purging plugs according to DE 39 11 881 C1 have proved to be generally successful.

However, metal melt infiltrations, which are undesirable, may occur when the gas pressure decreases or in the case of erosion phenomena in the gas discharge area of these gas purging plugs.

Alternative embodiments of gas purging plugs for the said field of application are therefore designed as so-called slot-type purge plugs, i.e., the directed pores have a slot shape rather than an annular shape like the small pipes. The surface tension of the metal melt is usually so high that infiltrations into the slot-like channels are ruled out practically completely. This is also true when the gas feed is switched off.

However, it was found that as erosion increases, these gas purging plugs sometimes lead to discharge cross sections that are not only relatively large, but also undefined. This causes a certain flow along the edges. Another problem is that the purging gas is no longer able to penetrate deep enough horizontally into the metal melt because of the enlarged cross-section area. It was frequently observed in experiments that the purging gas rises mainly along the wall, and thus it cannot completely fulfill its actual purpose any longer. In other words, the purging gas now enters the steel column in larger bubbles and under a lower pressure and flows upward along the inner wall of the blowpipe rather than in the center of the metal melt.

The basic task of the present invention is consequently to provide a gas purging means which ensures uniform gas feed into the metal melt with wall-side installation, feeding gas deep into the metal melt, so that a homogeneous gas distribution is achieved in the metal melt.

To accomplish this task, the present invention is initially based upon the consideration that this goal can be accomplished by arranging a plurality of gas purging plugs at spaced locations from one another, via which the treating gas can be introduced into the metal melt to different depths. A gas purging insert may be designed, e.g., such that the gas guided into the metal melt flows upward along the wall immediately after leaving the gas purging insert, while another gas purging insert is designed such that the gas is guided deep into the metal melt. Additional gas purging inserts may supply the area between the above-mentioned two gas purging inserts with gas.

In its most general embodiment, the present invention consequently pertains to a gas purging means for wall-side installation in a metallurgical melting vessel, such as a vacuum vessel for carrying out an RH, DH or RH-OB degassing processing, which is designed as follows:

The gas purging means consists of a basic body made of a refractory ceramic material.

At least two gas purging inserts, which possess at least one of the following features, are arranged in this basic body at spaced locations one above another:

The gas purging inserts either have the same structural design, but a different cross-sectional area at the gas outlet-side end. The gas is consequently discharged at a lower flow velocity from the gas purging plug with larger cross-sectional area than from a gas purging insert with a smaller cross-sectional area. The treating gas correspondingly enters the metal melt at varying depths.

According to an alternative embodiment, the gas purging inserts are different from the viewpoint of structural design. Structural means that they differ in terms of their structural design. One gas purging insert may be designed, e.g., with nondirected porosity and one gas purging insert may be designed with directed porosity. Based on the equality of the amount of gas fed in and of the gas pressure, the gas purging plug with nondirected porosity will press the treating gas into the metal melt under a lower pressure than does the gas purging insert with directed porosity.

However, it is finally also possible to admit different amounts of gas or gas under different pressures to the gas purging inserts. Thus, both gas purging inserts of identical structural design and gas purging inserts with different structural designs can lead to different purging effects if gas is admitted to them under different pressures or different amounts of gas are admitted to them.

Advantageous embodiments of the gas purging means are described by the features of the subclaims as well as the other application documents.

The gas purging inserts of a gas purging means may be designed, e.g., as follows:

they have the same structural design with nondirected porosity, but they have different cross-sectional areas at least at the gas outlet-side end, or the gas purging inserts have the same structural design, but directed porosity, and the number of directed pores differs, or at least one gas purging insert is designed with directed porosity and at least one gas purging insert is designed with nondirected porosity, or at least two gas purging inserts have nondirected porosity, but the porosity of at least one gas purging insert is larger than that of at least one other gas purging insert, or at least two gas purging inserts have directed porosity, but the cross-sectional area of the individual directed pores of at least one gas purging insert is larger than the cross-sectional area of the individual directed pores of at least one other gas purging insert.

The person skilled in the art has a large number of other possibilities for arranging a plurality of gas purging inserts (in a common gas purging means), which have different designs in terms of the amount of gas discharged and the gas discharge pressure.

If a gas purging insert with directed porosity is used, it may be designed as a so-called slot-type purging plug, i.e., the individual pore channels are designed with rectangular cross section, and the width does not usually exceed 1 mm.

Slot-type purging plugs and purging plugs with nondirected porosity offer the advantage that metal melt does not infiltrate the purging plugs even when the gas supply is switched off.

The risk of edge flow (uncontrolled gas flow at the outer periphery) described in the introduction is reduced or ruled out by jacketing the gas purging inserts with sheet metal. The gas purging inserts may be placed, jacketed with sheet metal in advance, into a corresponding opening in the gas purging means, and they are fixed there with, e.g., mortar.

In this embodiment, a gas distribution chamber may directly join the sheet-metal jacket of the gas purging insert, namely, at the gas inlet-side end. Such a gas distribution chamber, which is formed by, e.g., a metal box, may be designed individually for each gas purging insert; however, providing a common gas distribution chamber for all gas purging inserts, as a result of which the manufacturing cost is reduced, is also within the scope of the present invention. However, it is always advantageous for the metal frame of the gas distribution chamber to directly join the sheet-metal jackets of the gas purging inserts, so that the diffusion of the gas into the ceramic matrix material of the gas purging means is avoided with certainty.

Even though a gas purging plug to be inserted into metallurgical melting vessels, which is divided into individual sections separated from one another in a gas-tight manner, and to which one or more gas feed lines can be connected, has been known from DE 37 16 388 C1, the important feature of this gas purging plug is that it is possible to connect the individual sections one after another in order thus to be able to use the gas purging means for a longer time and to process, e.g., 40 or 50 heats with one gas purging means without repair or replacement measures.

Contrary to this, the gas purging means according to the present invention is designed such that gas is usually admitted simultaneously to the individual gas purging sections, but the gas discharged from the individual gas purging inserts penetrates into the metal melt to different depths based on the above-described measures.

BRIEF DESCRIPTION OF THE DRAWINGS

The present invention will be explained in greater detail below on the basis of an exemplary embodiment. In highly schematic representations.

FIG. 1 shows a basic body 10 made of a refractory ceramic material, which has a trapezoidal cross section.

Five truncated cone-shaped recesses 12*a–e*, in which five gas purging inserts 14*a–e* are embedded with mortar, extend in the basic body 10.

Figure 1:
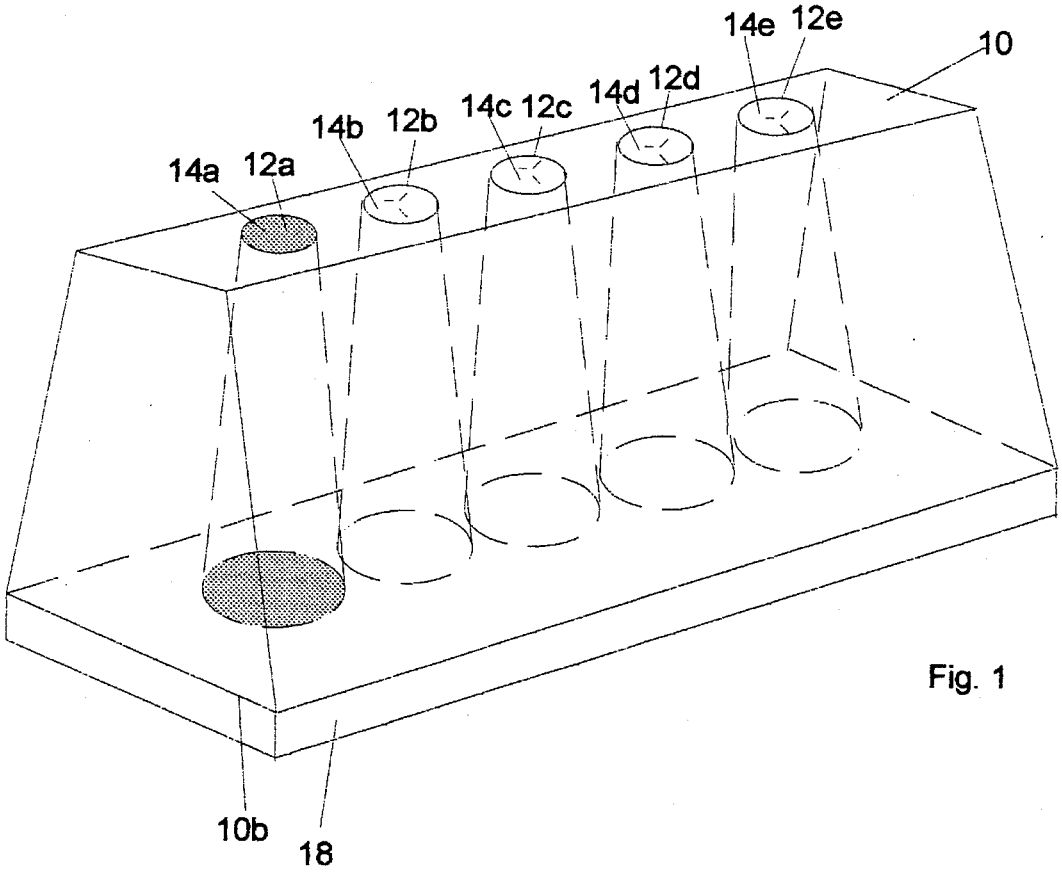
FIG. 1 shows a perspective view of a gas purging means according to the present invention with 5 gas purging inserts.
Figure 3:
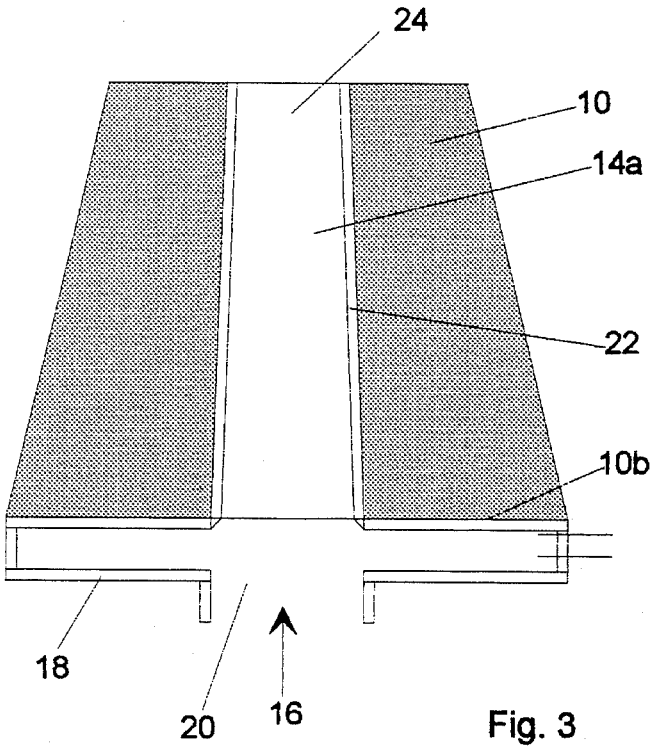
FIG. 3 shows a section through the gas purging means according to FIG. 1 in the area of a gas purging insert.
Figure 2:
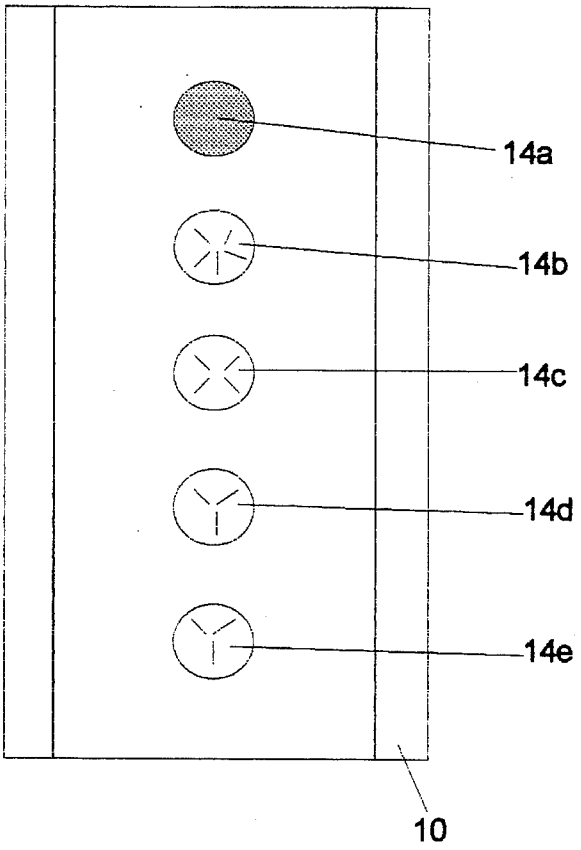
FIG. 2 shows a top view of the gas purging device according to FIG. 1.

Each of the gas purging inserts 14*a–e* is jacketed with sheet metal on the circumference, as is shown in FIG. 3, and is connected at the gas inlet-side end (at 16) to a common gas distribution chamber 18, which extends over the entire bottom area 10*b* of the basic body 10 and consists of a metal box, which has an opening 20 (with an attached pipe connection) to the central gas feed (at 16).

As is shown especially in FIG. 3, the metal frame of the gas distribution chamber 18 directly joins the sheet-metal jacketing 22, so that there is complete gas tightness against the basic body 10 between the gas feed (at 16) and the gas outlet-side end (at 24), so that the gas cannot diffuse into the basic body 10, but it can be guided via the gas distribution chamber 18 and the gas purging inserts 14*a–e* into the metal melt.

The design of the gas purging inserts 14*a–e* is of particular significance.

The gas purging insert 14*a* has nondirected porosity, which is schematically represented here by shading.

The gas purging inserts 14*b–e* are so-called slot-type purging plugs, and the gas purging insert 14*b* has five slots, the gas purging insert 14*c* has four slots, and the gas purging inserts 14*d* and 14*e* have three slots each.

The size of the slot (cross-sectional area of the slots) continuously decreases from the gas purging insert 14*b* to the gas purging insert 14*e*. In other words, the gas purging insert 14*b* not only has five slots, but these are also designed with a larger cross section than the four slots of the gas purging insert 14*c*, and even though the three slots of the gas purging insert 14*d* are smaller than the slots of the gas purging insert 14*c*, they are larger than those of the gas purging insert 14*e*.

In the case of uniform gas pressure in the gas distribution chamber 18, this leads to the following situation:

The gas is discharged uniformly over the entire cross-sectional area at the gas outlet-side end of the gas purging insert 14*a* under a relatively low pressure, and it flows upward almost exclusively in the wall area of the snorkle.

The increased number of slots and the larger width of opening of the slots in the gas purging insert 14*b* ensures that the gas will penetrate somewhat more deeply into the metal melt than does the gas fed in via the gas purging insert 14*a*.

The depth of penetration of the gas is correspondingly somewhat greater in the case of the gas purging insert 14*c* than in that of 14*b*, but smaller than in the case of the gas purging insert 14*d*. The gas purging insert 14*e*, which has only three slots with very small cross section, ensures that the gas passing through it can be guided into the metal melts with the greatest depth of penetration.

It is thus ensured over the height of the vertically installed basic body 10, e.g., in an RH vacuum vessel, that the gas is fed in practically continuously over the entire metal melt, and a uniform metallurgical treatment can take place. The steel flow rate in the inlet snorkle of the RH vacuum vessel is maintained at a constant value over the entire cross section, which means that it is approximately the same in the edge area as in the center.

In RH units, gas purging means of the above-described type may be installed in both snorkles (immersion pipes) and gas can be alternatingly admitted to them.

We claim:

1. Gas purging means for wall-side installation in a metallurgical melting vessel, comprising 1.1. a gas purging brick assembly including one basic body (10) made of a refractory ceramic material, and 1.2. a combination of at least two gas purging different inserts (14*a–e*), which are arranged at spaced locations above each other in the one basic body (10) and possess at least one of the following features:

1.2.1. the same structural design, but a different cross-section area at the gas outlet-side end, 1.2.2. a different structural design, 1.2.3. connected to gas feed lines which feed different amounts of gas or gas under different pressures or a combination of different amounts of gas and gas under different pressures to the gas purging inserts (14*a–e*).

2. Gas purging means in accordance with claim 1, in which the gas purging inserts have the same structural design with nondirected porosity, but different cross-sectional areas at the gas outlet-side end.

3. Gas purging means in accordance with claim 1, in which the gas purging inserts (14*b–e*) have the same structural design with directed porosity, but the number of directed pores is different.

4. Gas purging means in accordance with claim 1, in which at least one gas purging insert (14*b–e*) has directed porosity, and at least one gas purging insert (14*a*) has nondirected porosity.

5. Gas purging means in accordance with claim 1, in which at least two gas purging inserts have nondirected porosity, and the porosity of at least one gas purging insert is larger than that of another gas purging insert.

6. Gas purging means in accordance with claim 1, in which at least two gas purging inserts (14*b–e*) have directed porosity, and the cross-sectional area of the individual directed pores of at least one gas purging insert (14*b–d*) is larger than the cross-sectional area of the individual directed pores of at least one other gas purging insert (14*c–e*).

7. Gas purging means in accordance with claim 1, in which at least one gas purging insert (14*b–e*) is designed as a slot purging plug.

8. Gas purging means in accordance with claim 1, in which the gas purging inserts (14*a–e*) are jacketed with sheet metal (22).

9. Gas purging means in accordance with claim 8, in which the individual gas purging inserts are connected at the gas inlet-side end to a gas distribution chamber, which is formed by a metal box, which is connected to the sheet-metal jacket of the corresponding gas purging insert in a gas-tight manner.

10. Gas purging means in accordance with claim 8, in which the individual gas purging inserts (14*a–e*) are connected at the gas inlet-side end to a common gas distribution chamber (18), which is formed by a metal box, which is connected to the sheet-metal jackets (22) of the gas purging inserts (14*a–e*) in a gas-tight manner.

11. Gas purging means for wall-side installation in a metallurgical melting vessel, comprising 1.1 a gas purging brick assembly including one basic body (10) made of a refractory ceramic material, and 1.2 a combination of at least two gas purging different inserts (14*a–e*), which are arranged at spaced locations above each other in the one basic body (10) and possess at least one of the following features:

1.2.1. the same structural design, but a different cross-section area at the gas outlet-side end, 1.2.2. a different structural design, 1.2.3. connected to gas feed lines which feed different amounts of gas or under different pressures or a combination of different amounts of gas and gas under different pressures to the gas purging inserts (14*a–e*), in which at least one gas purging insert (14*b–e*) has directed porosity, and at least one gas purging insert (14*a*) has non-directed porosity, in which at least two gas purging inserts (14*b–e*) have directed porosity, and the cross-sectional area of the individual directed pores of at least one gas purging insert (14*b–d*) is larger than the cross-sectional area of the individual directed pores of at least one other gas purging insert (14*c–e*), in which at least one gas purging insert (14*b–e*) is designed as a slot purging plug, in which the gas purging inserts (14*a–e*) are jacketed with sheet metal (22), and in which the individual gas purging inserts (14*a–e*) are connected at the gas inlet-side end to a common gas distribution chamber (18), which is formed by a metal box, which is connected to the sheet-metal jackets (22) of the gas purging inserts (14*a–e*) in a gas-tight manner.

12. Gas purging means in accordance with claim 11, in which at least two gas purging inserts have nondirected porosity, and the porosity of at least one gas purging insert is larger than that of another gas purging insert.

* * * * *